US006568620B1

(12) United States Patent
Lampprecht et al.

(10) Patent No.: US 6,568,620 B1
(45) Date of Patent: May 27, 2003

(54) YARN FEEDER FOR TEXTILE MACHINES

(75) Inventors: Alfred Lampprecht, Betzweiler-Walde (DE); Hermann Schmodde, Horb-Dettlingen (DE); Eberhard Leins, Horb (DE)

(73) Assignee: Memminger-IRO GmbH (DE)

( * ) Notice: Subject to any disclaimer, the term of this patent is extended or adjusted under 35 U.S.C. 154(b) by 0 days.

(21) Appl. No.: 09/786,709

(22) PCT Filed: Aug. 13, 1999

(86) PCT No.: PCT/DE99/02548

§ 371 (c)(1),
(2), (4) Date: Mar. 7, 2001

(87) PCT Pub. No.: WO00/14002

PCT Pub. Date: Mar. 16, 2000

(30) Foreign Application Priority Data

Sep. 7, 1998 (DE) ..... 198 40 727

(51) Int. Cl.[7] ..... B65H 51/02; D04B 15/48
(52) U.S. Cl. ..... 242/366; 66/132 T
(58) Field of Search ..... 242/366.1, 366, 242/365.6, 364.9, 364.2; 66/132 T, 132 R, 125 R

(56) References Cited

U.S. PATENT DOCUMENTS

| | | | | |
|---|---|---|---|---|
| 2,259,202 A | * | 10/1941 | Cooper | 242/366 |
| 3,922,887 A | * | 12/1975 | Mishcon | 242/365.6 |
| 3,957,217 A | * | 5/1976 | Clemens | 66/132 R |
| 4,180,215 A | * | 12/1979 | Nurk | 242/365.6 |
| 4,271,687 A | * | 6/1981 | Memminger et al. | 66/132 T |
| 4,574,597 A | | 3/1986 | Buck et al. | |
| 4,645,134 A | * | 2/1987 | Sarfati | 242/365.4 |
| 4,687,150 A | | 8/1987 | Gutschmit | |
| 4,793,565 A | * | 12/1988 | Fecker | 242/366 |
| 4,918,948 A | | 4/1990 | Nurk | |
| 5,802,881 A | | 9/1998 | Lin | |
| 5,839,685 A | | 11/1998 | Chen | |
| 6,015,109 A | * | 1/2000 | Ohlson et al. | 242/364.9 |
| 6,149,092 A | * | 11/2000 | Chen | 242/366 |

FOREIGN PATENT DOCUMENTS

| | | |
|---|---|---|
| DE | 3326099 | 2/1985 |
| DE | 3516891 C | 10/1986 |
| DE | 3711558 C | 6/1988 |
| DE | 9215924 U | 3/1993 |
| DE | 4141712 A | 6/1993 |
| DE | 29616525 U | 11/1996 |
| EP | 0217373 A | 4/1987 |
| EP | 0568762 A | 11/1993 |
| GB | 2174727 A | 11/1986 |

* cited by examiner

*Primary Examiner*—Michael R. Mansen
(74) *Attorney, Agent, or Firm*—Leydig, Voit & Mayer, Ltd.

(57) ABSTRACT

A yarn feeder has a yarn feed wheel, which preferably comprises ceramic or is coated with a corresponding material. The yarn feed wheel, because of the choice of its material or its shaping, has improved long-term operation properties. The geometry and/or the material has low susceptibility to wear. This is attained by means of ceramic surfaces and/or the combination of a conical, continuous yarn inlet surface with adjoining striplike bearing faces in the yarn storage region and a continuous, that is, uninterrupted surface in the yarn payout region; the surfaces are shaped such that the yarn, along its way from the inlet region into the payout region, sweeps over the corresponding surfaces over the entire axial course. The striplike supporting or bearing of the yarn in the yarn storage region is attained by suitable shaping of the yarn feed wheel in the yarn storage region. Openings or slits or the like in the yarn feed wheel are not necessary but may be provided.

17 Claims, 5 Drawing Sheets

YARN FEEDER FOR TEXTILE MACHINES

FIELD OF THE INVENTION

The invention relates to a yarn feeder which can be used particularly for positive furnishing of yarns to textile machines.

BACKGROUND OF THE INVENTION

The yarns to be furnished to individual yarn consuming stations of a textile machine can have quite different properties, depending on the material used, the twist, the yarn thickness, and other characteristics, and these properties also are found in the yarn feeder. For instance, cotton yarns, synthetic yarns, different processed or equipped yarns, such as smooth yarns, twisted yarns, kinky yarns, and so forth can behave differently. As a rule, yarn feeders should be capable of furnishing several or all of the yarns mentioned without difficulties.

Problems can arise here with yarns that shed dust, that have filaments protruding from the yarn, that carry a relatively large amount of sizing, or that in some other way leave behind or cause traces or deposits on parts of the yarn feeder. Deposits of fluff, which are located especially on the yarn feed wheel of a yarn feeder, can impair yarn travel and yarn feeding and in an extreme case can cause the yarn to tear.

From German Patent DE 35 01 944 C2, a yarn feeder is known that has a rotationally supported and driven yarn feed wheel, which is formed by a yarn storage drum provided with a plurality of conical regions. A first conical region with a cone angle of 150 forms the yarn inlet region. This is adjoined by a further yarn inlet region with a cone angle of 14, which is adjoined by a practically cylindrical yarn storage region.

The diameter of the yarn windings resting on the yarn inlet region decreases in the axial direction of the relatively long yarn inlet regions. The incoming yarn pushes the windings, already located in the inlet regions, in the axial direction, causing them to migrate toward the storage region, and the yarn tension in the individual windings can then vary. The yarn properties affect this process.

From German Patent DE 33 26 099 C2, a yarn feeder is also known which also has a rotatably supported and rotationally driven yarn feed wheel. The yarn feed wheel has a yarn inlet region, defined by two cones adjoining one another, and a yarn storage region adjoining it via a step that in one version is cylindrical or ribbed. The yarn feed wheel can be in a single part or in multiple parts. From the same patent, it is also known to provide the yarn inlet region and/or the yarn storage region with recesses, so as to bring about only a single uninterrupted support of the yarn in these regions. The storage drum in each version has a disk-like flange that extends in the radial direction on its lower end remote from the yarn inlet region and forms a step with the yarn inlet region.

A yarn feeder is also known from Published Taiwanese Patent Application, published under No. 165470, with a yarn feed wheel which has a conically tapering inlet region, an approximately cylindrical yarn storage region, and a yarn payout region, which is formed by a portion embodied on the order of a pulley. At the transition from the storage region to the pulley-like portion, there is a conical transitional region. In the yarn storage region, a flutelike groove extending around the circumference is provided, which divides the yarn storage region into individual contact faces separated from one another.

The yarn feed wheel has a relatively complicated shape.

From Taiwanese Utility Model published under No. 314077, a yarn feeder is known that has a rotationally symmetrical yarn feed wheel which is embodied in one piece and has a yarn inlet region, a yarn storage region, and a yarn payout region. The yarn inlet region with a convex curvature follows an annular cutout from a torus, while the yarn storage region is approximately cylindrical. Adjoining the yarn storage region, the diameter of the yarn feed wheel gradually increases, resulting in a conical region with a cone angle of a few degrees.

The incoming yarn presses the yarn windings located on the cylindrical yarn storage region axially away from the inlet region during operation of the yarn feeder, and the static friction of the entire package has to be overcome.

From German Utility Model DE 296 16 525 U1, a yarn feeder is known with a yarn feed wheel made up of multiple parts, in which the yarn inlet region, the yarn storage region and the yarn payout region are formed by axially extending ribs, whose outer profile defines the contour of the yarn feed wheel. The ribs are held at their ends on end disks.

The package advancement on the yarn feed wheel brought about by the incoming yarn is limited to the narrow ribs in the yarn inlet region. The ribbed yarn payout region can lead to turbulent yarn travel.

From European Patent Disclosure EP-A 0 568 762, a yarn feeder is known that has a yarn guide drum which has a conical upper and lower edge, and between them has a cylindrically embodied yarn storage region. Over a certain portion of its axial length, the cylindrical yarn storage region is provided with slots, which are covered by the yarn package. Between the slots, there are lands whose outer contour is located on the cylindrical surface that is defined by the cylindrical storage region.

The yarn wound as a package onto the storage region rests on the edges of the lands, which can be disadvantageous in the case of delicate yarns.

Regardless of wear, different yarns and packages behave differently. Differences exist particularly between smooth yarns and yarns with filaments, in which individual windings rest on filaments of adjacent windings and can firmly clamp them. It will be appreciated, however, that the usefulness of yarn feeders should not be limited to certain yarns.

SUMMARY OF THE INVENTION

With this as the point of departure, it is the object of the invention to create a yarn feeder whose operation properties are largely independent of the nature of the yarn. This object is attained by a yarn feeder having a yarn feed wheel with a special geometry that facilitates the feeding and payout of yarn onto and from the yarn feed wheel.

The yarn feed wheel of the yarn feeder may have a wearproof surface, which is applied to a carrier of lesser hardness, such as a metal body, or it may entirely comprise these substances. The yarn feed wheel is preferably in one piece, which makes economical manufacture possible. The yarn feed wheel is preferably embodied without through openings in its yarn inlet region, storage region and yarn payout region, so that it surrounds a closed interior. The storage region is preferably embodied as a substantially closed surface configuration, in which as needed relatively small openings spaced apart from the yarn bearing regions can also be provided. Fluff or other deposits are then unable to stick in the openings over which the yarn sweeps and impede yarn travel. The abrasion resistance prevents the development of scratches or bumps or other traces of wear, which over the long term could interfere with proper operation, and especially the even advancement of the package.

In the yarn feed wheel with a ceramic surface, it has also proved to be advantageous to embody the yarn inlet region and the yarn payout region as a closed surface, preferably with a circular cross section at every point. Conversely, the yarn storage region can have a cross section other than the circular form. For instance, the cross section can be defined polygonally, and either straight or indented edges may be provided between the individual, somewhat rounded corners of the polygon. The indented edges may be concave or intermittently concave and convex.

Such a design prevents the deposition of continuous rings of fluff or relatively large plugs of fluff in recesses, and the support of the yarn package remains concentrated on individual edge regions of the yarn segment. This facilitates the axial displacement of the package, so that the package can be displaced in controlled fashion even with different yarns or threads. Even if the bearing faces become worn somewhat, conditions are not fundamentally changed, and the yarn feeder functions reliably. Because the package is laid on in the storage region only in striplike bearing regions, it is easier to feed yarns that have many filaments, in particular. Because of the package advancement, filaments that get under the package can be firmly clamped only in the bearing regions. The outgoing yarn thus is easily separated from the package. If filaments that have caught remain under the package and are thus drawn off from the yarn, still no cohesive rings of fluff are created on the yarn feed wheel.

The cooperation of a closed structural shape of the yarn feed wheel with striplike contact faces in the storage region and closed, smooth surfaces in the inlet region and the payout region, which merge with one another without shoulders edges or steps, makes for good advancement with little static friction, and the deposition of fluff and the formation of rings of fluff as well as generation of wind or air flow by the yarn feed wheel are avoided.

The yarn feed wheel, which comprises or is coated with ceramic or some other of the aforementioned hard substances can be embodied in one piece, which makes it possible for the entire surface swept by the yarn to be seamless. The yarn can thus travel unhindered, and there is hardly any risk that it might get caught at a seam, for instance.

Advantageously, the yarn touches the surface of the yarn feed wheel uninterruptedly in the yarn inlet region and is guided in such a way that the yarn payout region can be swept clean by the yarn. This is attained by disposing the yarn payout eyelet or some suitable guide device at a radial spacing from the pivot axis of the yarn feed wheel and below a plane defined by the lower edge, with the result that the yarn rests on the yarn feed wheel, including at the transition from the storage region to the payout region, until it finally separates from the package.

The hub of the yarn feed wheel can be embodied integrally with it. The yarn feed wheel is then a single one-piece component. This makes manufacture and production simpler. The hub is preferably formed by an end wall of the yarn feed wheel.

If the yarn feed wheel comprises an optionally coated metal, such as aluminum, then it is considered advantageous to produce the yarn feed wheel by deep drawing or by shaping from a solid block. The yarn inlet region, the yarn payout region and preferably also the face-end wall or hub of the yarn feed wheel are embodied from a blank in one or more successive shaping steps. If needed, the shaft that carries the yarn feed wheel can also be embodied integrally with the yarn feed wheel.

Advantageous details of embodiments of the invention are the subject of dependent claims or will be apparent from the drawing or the description. Embodiments of the invention are shown in the drawing. Shown are:

DETAILED DESCRIPTION OF THE DRAWINGS

Figure 1:
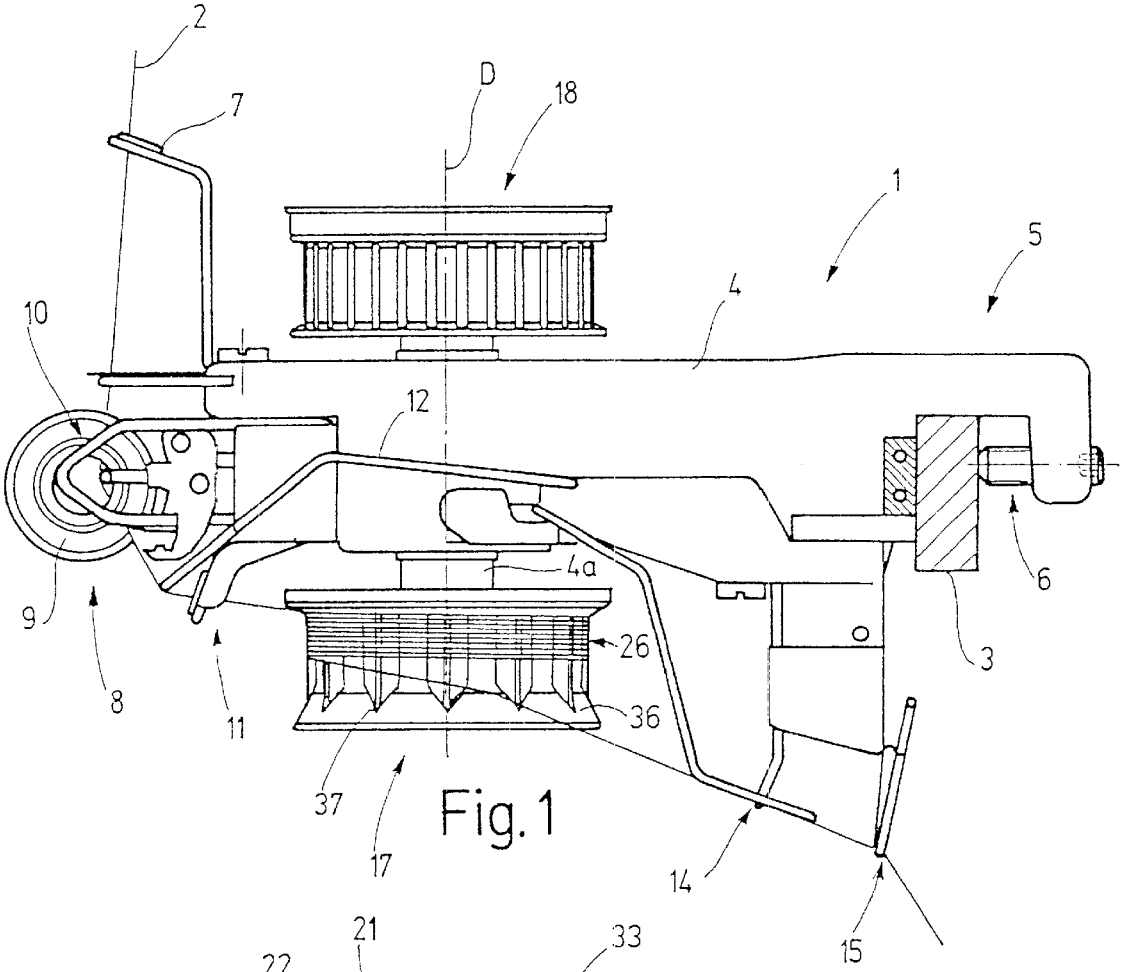
FIG. 1, a yarn feeder with a ceramic yarn feed wheel, in a schematic side view.

In FIG. 1, a yarn feeder 1 is shown which serves to feed a yarn 2 to a textile machine, not otherwise shown. The yarn feeder 1 is supported on a corresponding retaining ring 3 of the textile machine. As a rule, a plurality of identical yarn feeders 1 are held on the retaining 3 and jointly driven.

The yarn feeder 1 has a housing 4, which on one end 5 is embodied as a holder with which it at least partly grasps the retaining ring 3 and is held thereon by means of a clamping screw 6.

On the end remote from the holder 5, the housing 4 is provided on the yarn inlet side with a yarn inlet eyelet 7, which guides the yarn to a yarn brake 8. The yarn brake has brake rings 9, for instance two in number, that are held magnetically together and that are set rotatably and with play in a mount 10. The yarn brake is followed by a yarn guide eyelet 11, also held on the housing 4; the yarn is sensed between the yarn brake 8 and the yarn guide eyelet by a yarn sensor 12. The yarn feeler is formed by a pivot lever, which is kept by the yarn 2 in its upper position. If the yarn breaks, the lever 12 drops downward, and a switch actuated by it outputs a signal accordingly.

Also provided on the housing 4 are yarn guide eyelets 14, 15, which define the yarn course at the outlet of the yarn feeder 1. Between the yarn guide eyelet 11 and the yarn eyelet 14, a yarn feed wheel 17 is provided, which is held on one end of a shaft 4*a* rotatably supported in the housing 4. This shaft is disposed concentrically to a pivot axis D. A pulley 18 is retained on the end of the shaft 4*a* remote from the yarn feed wheel 17 and is connected in this way to the yarn feed wheel 17 in a manner fixed against relative rotation. The pulley 18 is for instance a toothed belt pulley or the like.

Figure 2:
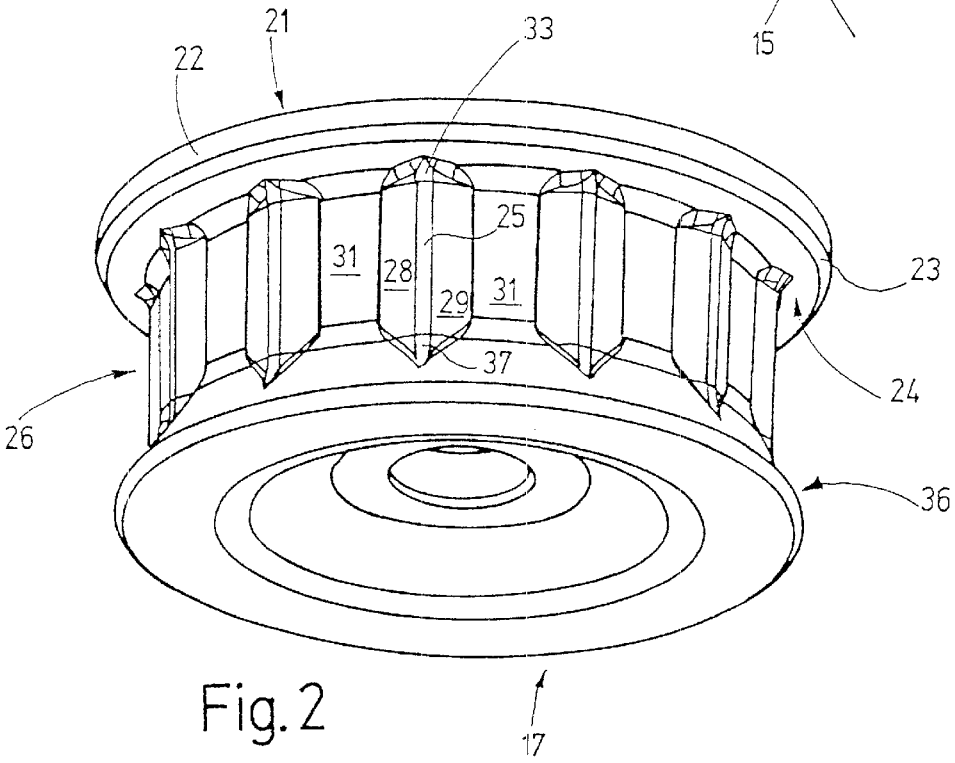
FIG. 2, the yarn feed wheel of the yarn feeder of FIG. 1 in a perspective view on a different scale.

The yarn feed wheel 17 is shown in FIGS. 2–10. As FIG. 2 shows, the yarn feed wheel 17 is a one-piece, rotationally symmetrical body with a profiled outside. The yarn feed wheel 17, on its end, has an initially radially outward- and then axially extending edge 21, which is defined on its outside by a cylindrical surface 22 (see FIGS. 2, 6, 9 and 10). The cylindrical edge changes over with a radius, via a curved surface region 23, into a yarn inlet region 24, which is formed by a conical surface portion. This surface portion is inclined by an angle of 10 to 20 (preferably 15) to a plane to which the pivot axis D of the yarn feed wheel is perpendicular. The generatrix of the surface portion is preferably a straight line.

The yarn feed wheel 17 is oriented concentrically to the pivot axis D. The yarn inlet region 24 is formed by a closed annular surface. Alternatively, individual recesses may be provided in the conical surface; the remaining regions that carry the incoming yarn are wider, however, than bearing regions 25 of the yarn feed wheel 17, which are associated with a storage region 26.

Figure 7:
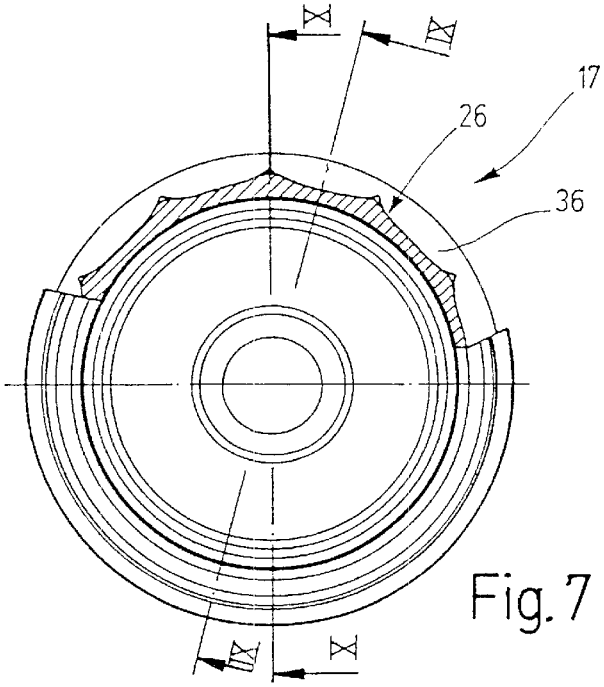
FIG. 7, the yarn feed wheel of FIG. 2, partly in section along a plane to which the pivot axis of the yarn feed wheel is perpendicular.

The storage region directly adjoins the yarn inlet region 24. As FIGS. 7 and 8 particularly show, it is defined by a cylindrical basic shape, extending outward from which are striplike, riblike or strutlike protrusions 27 spaced apart from and parallel to one another, which are each rounded at the apex. The radius of the rounding at the apex is from 1 to 2 and preferably 1.5 mm; the rounding defines or forms the bearing face 25. Adjoining the curved bearing face 25, which is approximately equivalent to a striplike portion from a cylindrical surface, plane surface regions 28, 29 extend at an angle of approximately 130 to 140 and preferably 135 from one another, as FIG. 5 particularly shows, away to intermediate surface regions 31, which are located on a cylinder that is concentric with the pivot axis D and defines the cylindrical basic shape. The intermediate surface regions 31 come relatively close to a yarn resting on the bearing faces 25 and wrapping around the yarn feed wheel 17, but do not quite touch it. A yarn wrapped around the yarn feed wheel 17 therefore, with its filaments, clears the interstice between the bearing faces 25, without touching the intermediate faces 31. This is shown particularly by FIG. 7 together with FIGS. 9 and 10. If the yarn feed wheel 17 of FIG. 7 is cut along the line IX—IX, it can be seen from FIG. 9 that the bearing face 25 is raised only slightly relative to the intermediate face 31. The radial spacing between the yarn and the intermediate and the intermediate surface region is preferably less here than 2/10 to 3/10 of a millimeter. The intermediate face 31 may also be embodied in plane form and be disposed parallel to the yarn that extends as a chord from one bearing region 25 to another bearing region 25. The spacing from the yarn is constant, which can be expedient for keeping the recess between bearing regions 25 clean.

Figure 5:
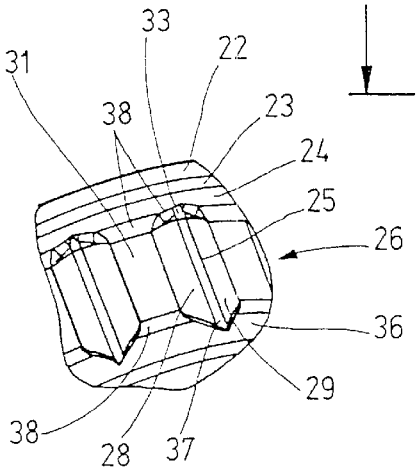
FIG. 5, the yarn feed wheel of FIGS. 2–4, in a detail on a different scale.
Figure 6:
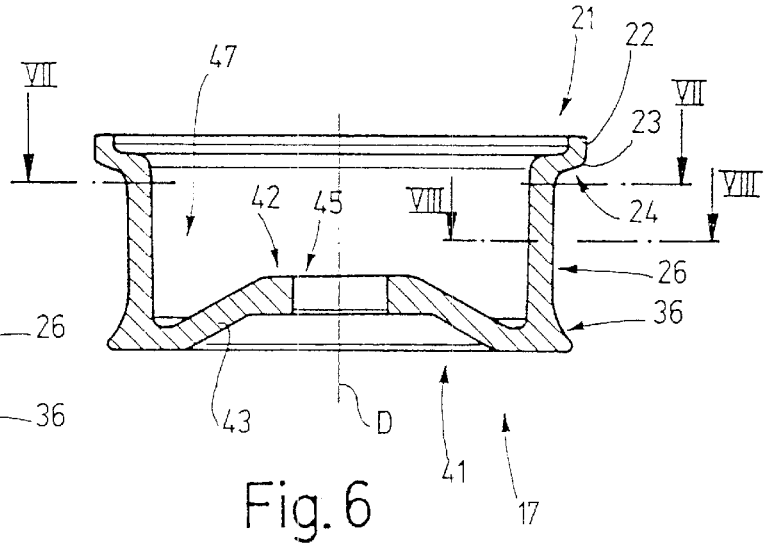
FIG. 6, the yarn feed wheel of FIG. 2, in a section taken along a plane that includes the pivot axis.
Figure 4:
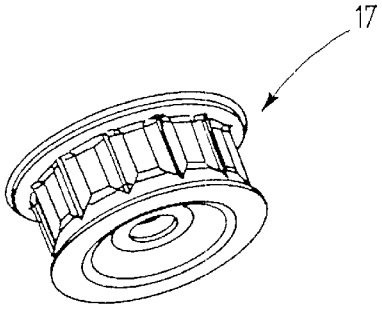
FIGS. 3 and 4, the yarn feed wheel of FIG. 2, in different perspective views.
Figure 3:
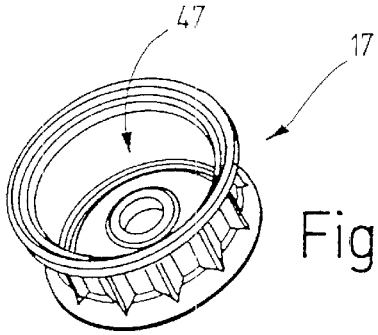
Figure 10:
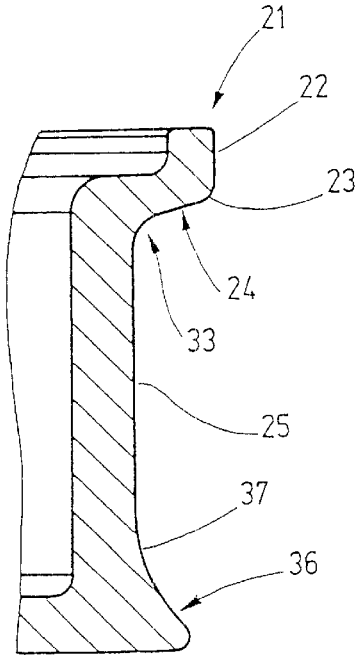
FIGS. 9 and 10, the yarn feed wheel of FIG. 7, in sections taken along the lines IX—IX and X—X, respectively and on a different scale.

The transition between the bearing face 25 and the yarn inlet region 24 is formed by a transitional region 33, which can be seen in FIG. 10 and in which the bearing face, as seen from FIG. 2 or FIG. 5, changes over, becoming narrower, into the yarn inlet region 24 and tapers to a point there. The transitional region 33 has a radius of 1 to 2 mm, preferably 1.5 mm, and is disposed between the yarn inlet region 24 and the storage region 26.

Figure 9:
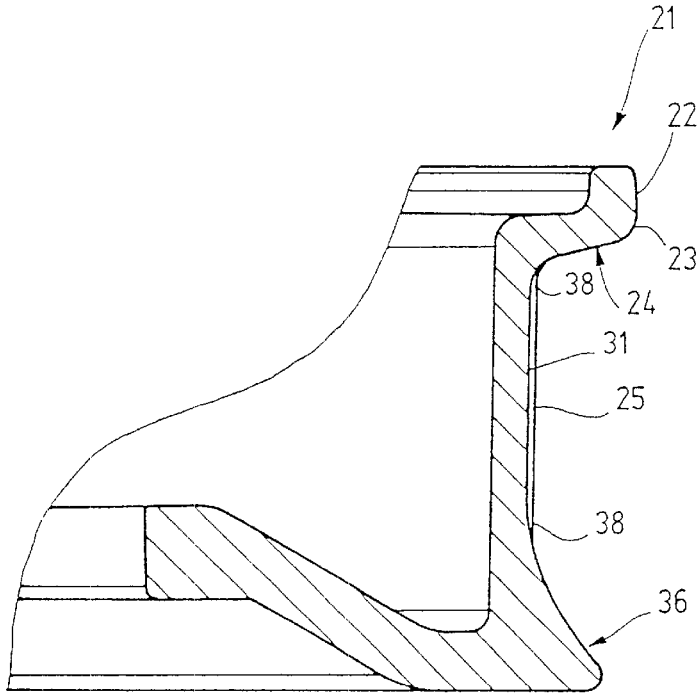

Adjoining the yarn storage region 26, the yarn feed wheel 17 has a yarn payout region 36, which is formed by a continuous surface. The surface of the yarn payout region 36 may be conical, with the generatrix being a straight line. In the present exemplary embodiment, the yarn payout region 36, as seen particularly from FIGS. 9 and 10, is additionally somewhat curved, however; that is, the diameter of the payout region increases disproportionately in the axial direction. The generatrix is a curve, for instance an arc of a circle. The yarn payout region is thus concave and curved with respect to the axial direction, while the storage region is substantially straight in the axial direction.

Figure 8:
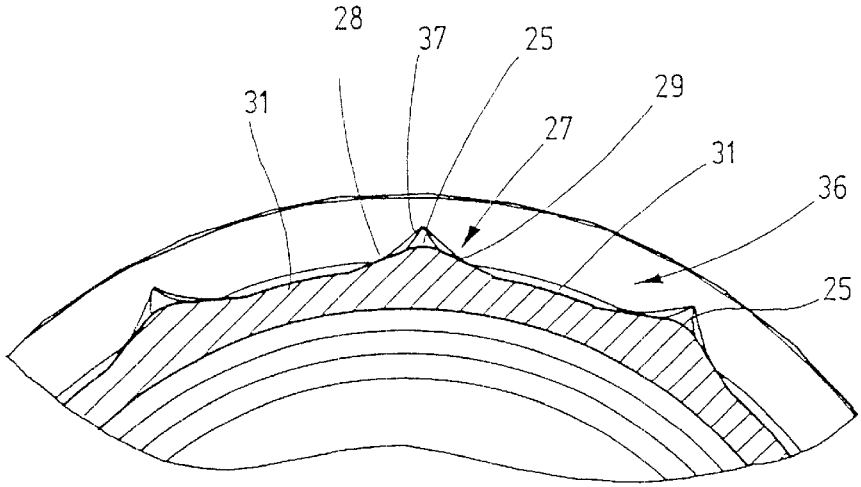
FIG. 8, the yarn feed wheel of FIG. 7, on a different scale.

The bearing regions 25 change over, with a transitional region 37 that tapers to a point as seen in FIG. 8, to the payout region 36. In the transitional region 37, which is disposed between the bearing face 25 and the payout region 36, a curvature begins at the bearing face 25, and the transitional region can have a radius which is shorter than the remaining radius of the payout surface 36.

In the yarn feed wheel 17, the intermediate surface region 31 and the planar surface regions 28, 29 (FIG. 5) also each adjoin adjacent surfaces with round throats 38. The formation of accessible corners where deposits could form is thus avoided.

The yarn feed wheel 17 is embodied as a hollow body. On its face end provided on the yarn payout region 36, it is closed by a wall 41, which is embodied integrally with the remainder of the yarn feed wheel. The wall 41 is offset in its middle region 42 away from the end plane of the yarn feed wheel 17. With a conical region 43, the middle region 42 adjoins the face-end edge of the yarn feed wheel 17. In the middle region 42, an opening 45 is made which is concentric with the pivot axis D, the yarn inlet region 24, the yarn storage region 26, and the yarn payout region 36. This opening serves to secure the yarn feed wheel 17 to the shaft 4*a*, which is seated with its end in the opening 45. In the setback formed by the middle portion 42, a fastening element, such as a nut or the like, may be disposed, which then does not protrude past the face end of the yarn feed wheel 17. The wall 41 may also be disposed on the top side of the yarn feed wheel 17 or somewhere else, for instance in a middle region.

The yarn feeder 1 described thus far functions as follows:

In operation, the yarn feed wheel 17, as shown in FIG. 1, carries a plurality of windings of the yarn 2. The yarn 2 thus extends from a yarn source, such as creel that carries the applicable bobbin, through the yarn feeder 1 to the textile machine that is to be supplied with yarn. In operation, a toothed belt, not otherwise shown, turns the toothed belt pulley 18 at a predetermined rpm. The yarn feed wheel 17 thereby continuously winds up yarn 2, which is thus drawn from the bobbin and by means of the yarn brake 8 arrives with a predetermined tension at the yarn feed wheel. Here, the yarn sweeps over the yarn inlet region 24.

If the yarn along its course to the yarn feed wheel runs via the yarn sensor 12 and the yarn eyelet 11 downstream of it, the individual yarns or filaments of the yarn 2 spread open somewhat along the way via the yarn sensor 12 and/or the yarn guide element 11. The yarn spreads apart crosswise to its travel direction, in a plane to which the pivot axis D of the yarn feeder 1 is approximately perpendicular. The filaments of the yarn that have been spread apart somewhat or placed side by side do not immediately spring back after crossing the yarn guide element 11; instead, the yarn 2 keeps its flattened form along the short distance to the yarn inlet region 24. The cone angle of the yarn inlet region 24 is dimensioned as so steep that the yarn inlet face is approximately parallel to the incoming yarn, or forms a very acute angle with it. The surface of the yarn inlet region leaves the yarn in its somewhat fanned-out state, so that the yarn runs, lying flat, over the yarn inlet region and arrives standing practically upright in the yarn storage region 26. At the transition, it is deflected 90 by the transitional regions 33; because it is introduced into the package in this way, the yarn also creates space for itself, or in other words axially displaces the package, if such displacement requires a relatively strong force. Thus the yarn 2 wound up by the rotating yarn feed wheel 17 is converted into the package lying on the bearing faces 26; the individual windings each follow a polygonal course, and the winding upon each revolution of the yarn feed wheel 17 executes an axial migration by a distance equivalent to the thickness of the yarn.

The yarn 2 travels with more or less high tension to the textile machine, which continuously takes up the yarn. In the process, the yarn separates from the package and travels obliquely over the yarn payout region 36 to the yarn eyelets 14, 15 disposed below the yarn feed wheel 17, but at a radial spacing from its pivot axis D. Even if the yarn, under the tension of the outgoing yarn passing via the lowermost eyelets 14, 15 is still separated from the package in the yarn storage region 26, the yarn rests on top of the bearing faces 25. Without lifting away from the bearing faces 25, the yarn is transferred via the transitional regions 37 to the payout region 36, which its sweeps over.

As an alternative to the embodiment described above, the wall of the yarn feed wheel 17 between the bearing regions 25 can be embodied rectilinearly, so that the yarn rests loosely on these wall regions, or in other words without any wall pressure. In this embodiment, the advantages of the merely striplike yarn contact in the bearing regions 25 is combined with the advantages of the uninterrupted yarn contact and as a result it is no problem to keep the yarn feed wheel 17 clean and to eliminate deposits.

The yarn feed wheel 17 described above is made in one piece of ceramic or a comparable yard material. This produces very good wear resistance.

As FIGS. 11–17 show, the yarn feed wheel may also be formed of a sheet-metal shaped part or metal part which is coated on its outside with a hard material coating, such as ceramic, sapphire, a nitride (for instance, titanium nitride) a carbide, a metal hard substance layer, or boride. If needed, it may also be provided with a coating containing diamond other hard crystals, such as a nickel coating containing a fine diamond powder. A quartz or enamel coating is also possible. In contrast to layers that grow on a base material such as aluminum, and thus in part grow into the base material by chemical conversion thereof, as is the case in electrolytic formation of aluminum oxide layers (anodizing), this involves layers that are applied to the base body. An exception is the sapphire layer, which besides oxygen and silicon can also contain some aluminum of the base material. Base body contours can be rounded somewhat as needed, which can be useful for yarn travel. The choice of the coating can also be made from standpoints pertaining to yarn transport, without being limited to certain surface treatment techniques.

Figure 11:
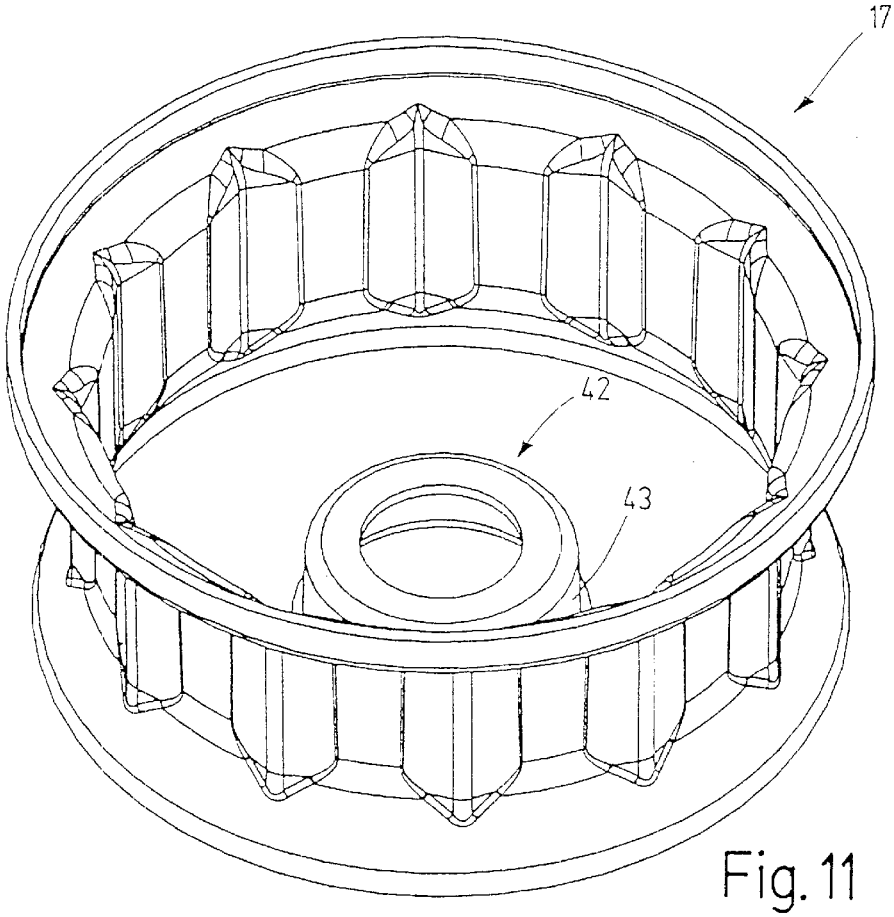
FIG. 11, the yarn feed wheel in a version of metal with a ceramic coating, in a perspective view.
Figure 12:
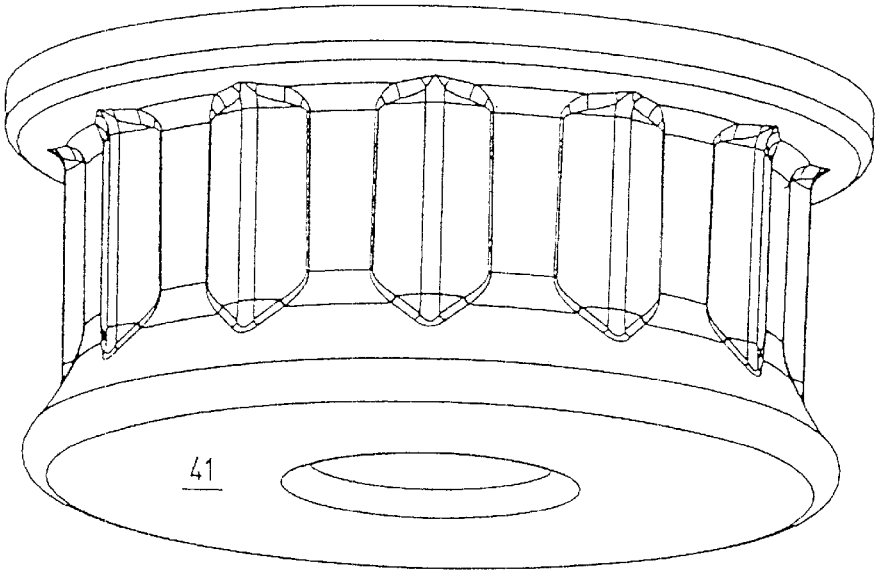
FIG. 12, the yarn feed wheel of FIG. 11, in a different perspective view.
Figure 13:
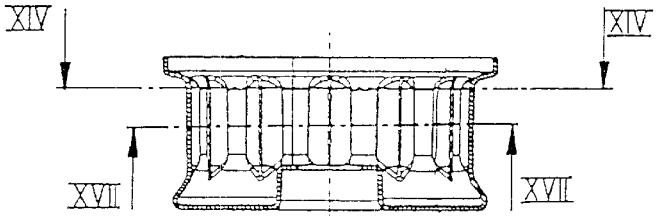
FIG. 13, the yarn feed wheel of FIG. 11, in a longitudinal section.
Figure 14:
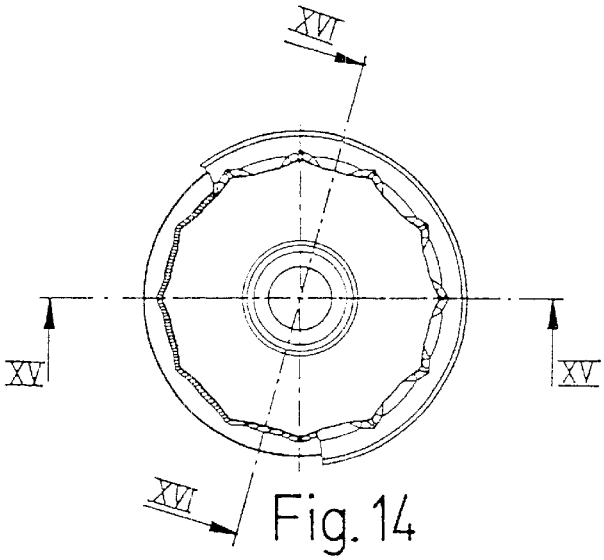
FIG. 14, the yarn feed wheel of FIGS. 11–13, in a section taken along the line XIV—XIV of FIG. 13.
Figure 15:
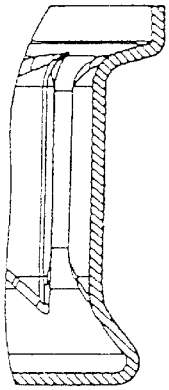
FIGS. 15–17, sectional views of the yarn feed wheel of FIG. 13 or 14, in sections taken along the lines XV—XV, XVI—XVI and XVII—XVII, respectively.
Figure 16:
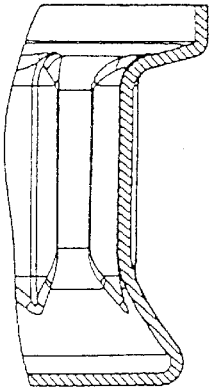
Figure 17:
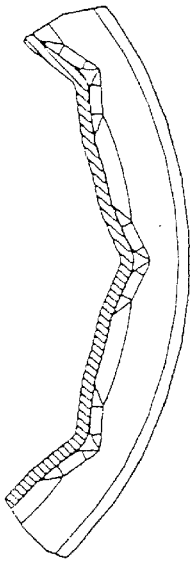

The geometry differs substantially from the wall thickness. The yarn feed wheel 17 made entirely of ceramic or a comparable hard substance has a relatively great wall thickness, while conversely the yarn feed wheel 17 of FIGS. 11–17 formed of a shaped sheet-metal part makes do with a less wall thickness. The yarn feed wheel 17 seen in FIG. 11 is hollow and is closed on its lower face end with a wall 41, whose central portion 42 forms a hub for securing it to a shaft. Instead of the conical region seen in FIG. 6, a cylindrical region 43 may be provided, in order to offset the central region 42 axially toward the end wall 41. With respect to the outer contour, the yarn feed wheel of FIGS. 11–17 matches that described above, however, to the extent that where the same reference numerals are used, the description applies accordingly.

The essential difference is in production. While a yarn feed wheel of ceramic is first pre-shaped and then fired, the yarn feed wheel 17 of FIGS. 11–17 can be made by shaping from a metal blank. After that, it should be provided with a coating as needed.

A yarn feeder 1 has a yarn feed wheel which preferably comprises ceramic or a hard substance or is coated with ceramic, sapphire, quartz, enamel, nitride, carbide, or a diamond-containing coating. Because of the choice of its material or its shaping, the yarn feed wheel has improved long-term operational properties. The geometry and/or the material is less susceptible to wear. This is attained by means of ceramic surfaces and/or the combination of a conical, continuous yarn inlet surface 24 with adjoining striplike bearing faces 25 in the yarn storage region 26 and a continuous, that is, uninterrupted surface in the yarn payout region; the surfaces are shaped such that the yarn, along its way from the inlet region into the payout region, sweeps over the corresponding surfaces 24, 25, 36 over the entire axial course. The striplike supporting or bearing of the yarn 2 in the yarn storage region is attained by suitable shaping of the yarn feed wheel 17 in the yarn storage region. Openings or slits or the like in the yarn feed wheel are not necessary but may be provided.

What is claimed is:

1. A yarn feeder for positive feeding of yarns comprising:

a yarn feed wheel that is rotatably supported about a pivot axis on a carrier, a drive mechanism for rotatably driving the yarn feed wheel, said yarn feed wheel comprising a single piece that includes a laterally extending yarn inlet region, a laterally extending yarn storage region, and a laterally extending yarn payout region, said yarn inlet region having a circular cross section at each lateral point that is concentric to the pivot axis with a diameter which decreases along the pivot axis in a lateral direction toward the storage region, said yarn payout region having a circular cross section at each lateral point that is concentric to the pivot axis with a diameter which increases along the pivot axis in a lateral direction away from the storage region, said storage region having contact regions for the yarn that are spaced apart from one another, said contact regions of the storage region of the yarn feed wheel each having a cross section which at least in some portions deviates from a circle that is concentric with the pivot axis, and said yarn inlet region, yarn storage region, and yarn payout region merge with one another without shoulders or steps which can impede lateral movement of yarn from the inlet region to the storage region and from the storage region to the outlet region.

2. The yarn feeder of claim 1, wherein the yarn inlet region of the yarn feed wheel comprises a closed surface.

3. The yarn feeder of claim 1, wherein the yarn inlet region of the yarn feed wheel forms an angle with the pivot axis that is greater than 60°.

4. The yarn feeder of claim 1, wherein the yarn payout region of the yarn feed wheel comprises a closed surface.

5. The yarn feeder of claim 4, wherein the yarn payout region of the yarn feed wheel is embodied as a closed conical surface with a circular conical contour whose radius of curvature is shorter than the radius of the yarn feed wheel.

6. The yarn feeder of claim 4, wherein the yarn payout region of the yarn feed wheel is embodied as a curved surfaced located on a torus, whose radius of curvature is shorter than the radius of the yarn feed wheel.

7. The yarn feeder of claim 1, wherein the storage region disposed between the yarn inlet region and the yarn payout region has a substantially closed surface configuration.

8. The yarn feeder of claim 1, wherein the storage region has a polygonal cross section concentric with the pivot axis at every point, and the polygon defined by the cross section of the storage region has straight edges.

9. The yarn feeder of claim 1, wherein the storage region has a polygonal cross section concentric with the pivot axis at every point, and the polygon defined by the cross section of the storage region has non-straight edges.

10. The yarn feeder of claim 1, wherein the cross section of the storage region is defined radially on the outside by rounded bearing regions, between which the outer surface of the storage region extends radially inward, and convex surface regions are formed between adjacent bearing regions.

11. The yarn feeder of claim 1, wherein the cross section of the storage region is defined radially on the outside by rounded bearing regions, between which the outer surface of the storage region extends radially inward.

12. The yarn feeder of claim 1, wherein the cross section of the storage region is defined radially on the outside by rounded bearing regions, between which the outer surface of the storage region extends radially inward, and planar surface regions are formed between adjacent bearing regions.

13. The yarn feeder of claim 1, wherein the yarn feed wheel has a base body comprising ceramic, sapphire, quartz, diamond-containing material, nitride or carbide.

14. The yarn feeder of claim 1, wherein the yarn feed wheel has a base body coated with enamel, ceramic, sapphire, quartz, diamond-containing material, nitride or carbide.

15. The yarn feeder of claim 1, wherein the yarn feed wheel has a base body comprising metal.

16. The yarn feeder of claim 15, wherein said metal base body has a coating containing oxygen and a further component different from the base material.

17. The yarn feeder of claim 1, wherein the yarn feed wheel has an end wall on the one side that is provided with a central bore, with which the yarn feed wheel is received by a shaft.

* * * * *